United States Patent [19]

Ballard

[11] 4,301,985

[45] Nov. 24, 1981

[54] FURNITURE

[75] Inventor: L. David Ballard, Hong Kong, Hong Kong

[73] Assignee: The Otto Gerdau Co., New York, N.Y.

[21] Appl. No.: 43,618

[22] Filed: May 30, 1979

[51] Int. Cl.[3] ..... A47C 4/02; F16M 11/16

[52] U.S. Cl. ..... 248/188; D6/177; 248/188.8; 297/440

[58] Field of Search ..... 108/157, 159, 153, 156; 297/440; D6/57, 55, 58, 177; 248/188, 188.8

[56] References Cited

U.S. PATENT DOCUMENTS

| | | | |
|---|---|---|---|
| Re. 28,244 | 11/1974 | Evans | 108/157 |
| D. 228,106 | 8/1973 | Klotz | D6/177 |
| 2,480,559 | 8/1949 | Derse, Sr. | 108/156 |
| 2,533,313 | 12/1950 | Flicker | 108/156 |
| 3,094,848 | 6/1963 | Albecht | 108/159 X |
| 3,146,025 | 8/1964 | Heaney | 108/159 X |
| 3,521,579 | 7/1970 | Stafford | 108/153 X |
| 3,867,967 | 2/1975 | Rocchia | 139/424 |
| 4,216,995 | 8/1980 | Inaba | 248/188 X |
| 4,222,559 | 9/1980 | Hammer | 248/188 |
| 4,234,226 | 11/1980 | Colby | 297/440 X |

FOREIGN PATENT DOCUMENTS

| | | | |
|---|---|---|---|
| 449548 | 4/1968 | Switzerland | 108/157 |

*Primary Examiner*—James T. McCall
*Attorney, Agent, or Firm*—Kalish & Gilster

[57] ABSTRACT

An article of furniture which is capable of being assembled from two or more component parts. Adjacent component parts of the article are held together along adjacent sides by the engagement of a spigot on one part in a socket in the other part, the spigot extending in a direction generally parallel to the said adjacent sides, and by further connecting means spaced from the spigot and socket.

3 Claims, 5 Drawing Figures

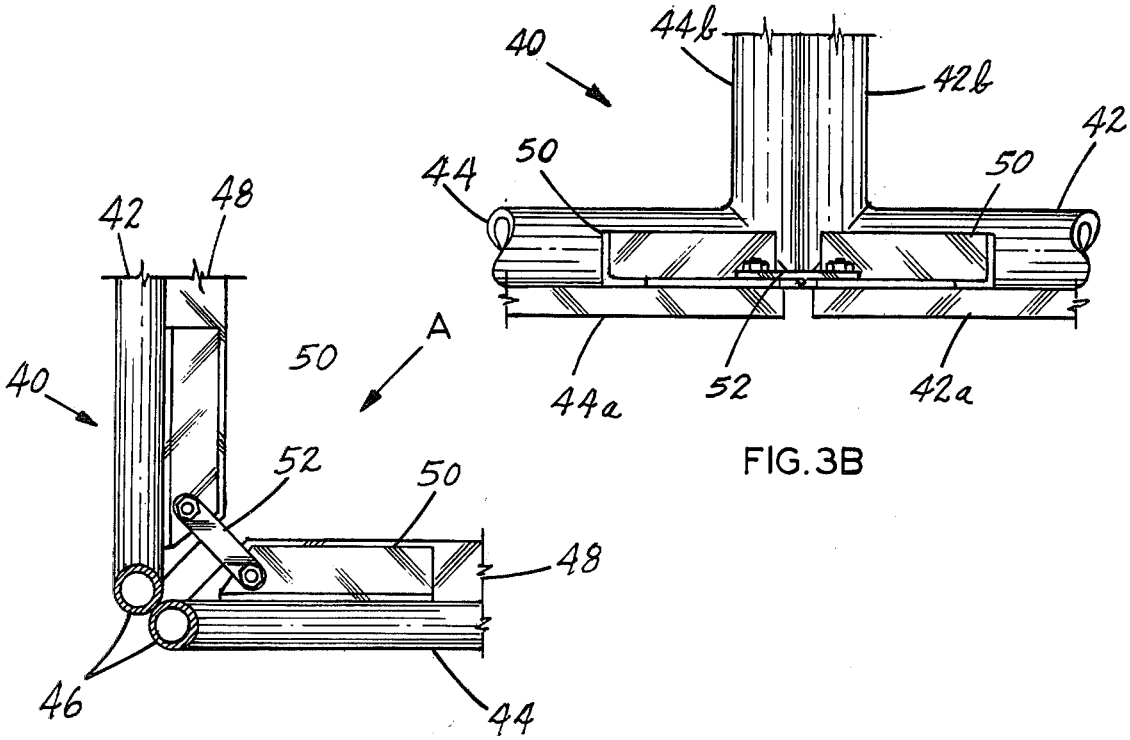
FIG. 3B
FIG. 3A
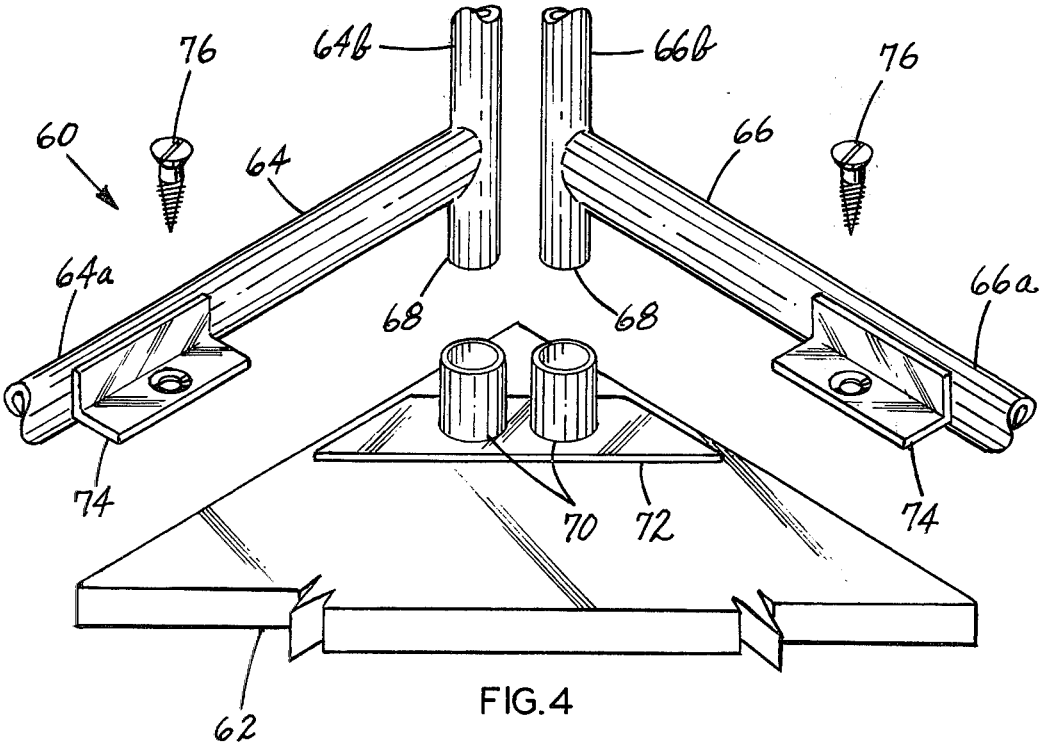
FIG. 4

FURNITURE

This invention relates to furniture and in particular furniture which can be shipped or stored in a flat configuration and then assembled at its destination.

According to the invention there is provided an article of furniture which is capable of being assembled from two or more component parts, in which adjacent component parts are held together along adjacent sides by the engagement of a spigot on one part with a socket in the other part, the spigot extending in a direction generally parallel to the said adjacent sides, and by further connecting means spaced from the spigot and socket.

An article of furniture according to the invention can be relatively quickly and easily assembled from the component parts. Thus the spigot on one part is slotted into the socket on the other part and then the further connecting means used to fix the two parts together so as to prevent the spigot from coming out of the socket and give rigidity and optionally shape to the assembled parts.

The invention is particularly, although not exclusively, useful in the construction of articles of furniture made from rattan or wicker work or upholstered articles of furniture. Thus each component part can comprise a frame which may be a metal frame for strength, particularly steel, and the rattan work, or wicker work can then be woven around and between the frame so as to hide the frame or the frame can be hidden by the upholstery. In the case where the frame is made of metal tubing it is very convenient for the socket to be constituted by the hollow interior of a part of the tubing constituting the frame.

The spigot and socket are preferably positioned at the lower end of the article. In the case where the article has legs, a leg can be constituted by portions of adjacent component parts with the spigot and socket positioned at the lower end of the leg. In this location the spigot and socket are hidden from view when the article of furniture is resting on the floor.

Preferably one component part has a small metal plate projecting from it and the spigot is joined to, or formed integrally with, that plate and projects upwardly from that plate in a direction generally parallel to the adjacent edge of the component part.

The further connecting means can comprise a brace which is for example joined by screws or nuts and bolts to each of the adjacent component parts and this brace may have the additional function of ensuring that adjacent component parts are maintained at the correct relative orientation, e.g. at right angles to one another. Alternatively the connecting means could include a spigot or socket on each of the adjacent component parts and a socket or spigot on a further component part additionally to be joined to the said adjacent component parts.

The invention is applicable to all types of furniture including for example chairs, tables, settees, stools and ottoman.

Besides having the advantage that the article of furniture in accordance with the invention can be disassembled and packed flat for storage and/or shipping, the invention has the additional advantage in that one type of component part can be used together with various different other components in order to produce differing articles of furniture. Thus for example the side pieces to constitute a chair can be identical with the side pieces used to make a sofa of two or more seats simply by the use of differning sized front and rear members for the article. Equally the same front and rear members of, for example a chair, can be used with differing side pieces, e.g. side pieces which have arms or side pieces without arms. The invention therefore enables one to reduce the number of component pieces needed in the design of a range of furniture.

The invention will now be described, by way of example, with reference to the accompanying drawings, in which:

FIG. 3A is a sectional detail taken from the underneath showing a table made according to the invention;

FIG. 3B is a view of the table shown in FIG. 3A taken in the direction of the arrow A; and FIG. 4 is an exploded view of another table according to the invention.

Figure 1:
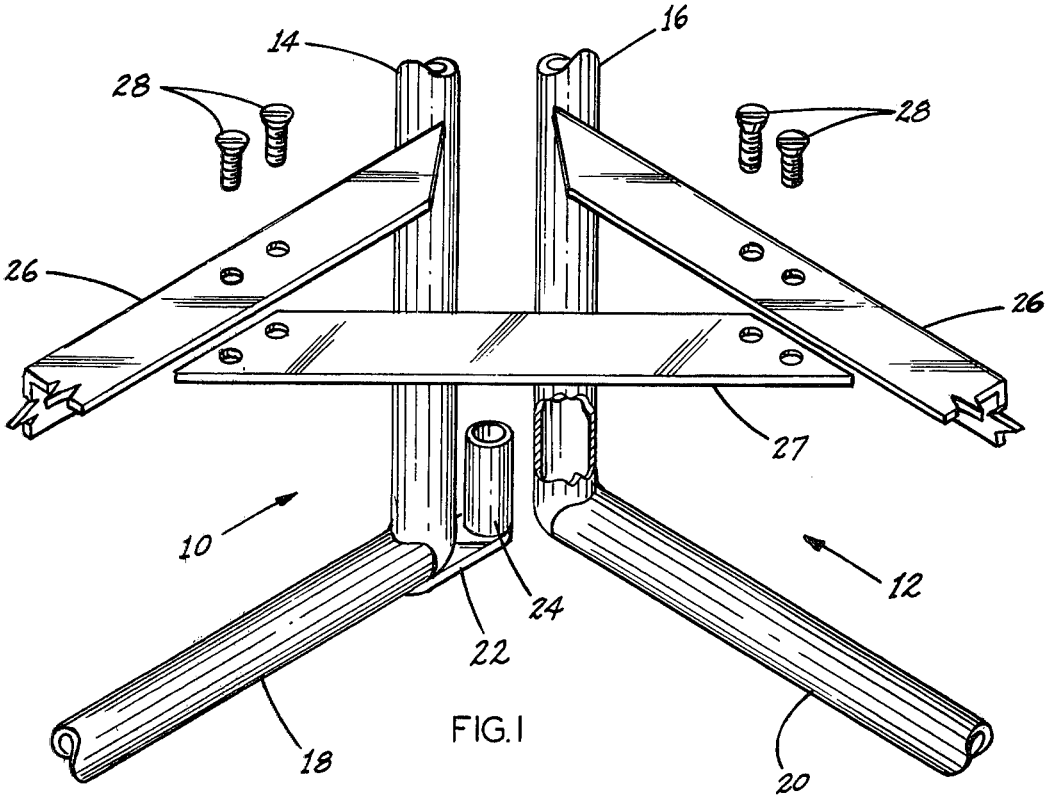
FIGS. 1 and 2 are detailed perspective views of the frames of adjacent component parts of an article of furniture according to the invention, FIG. 1 showing the parts in a disassembled position and FIG. 2 showing the two parts assembled together.
Figure 2:
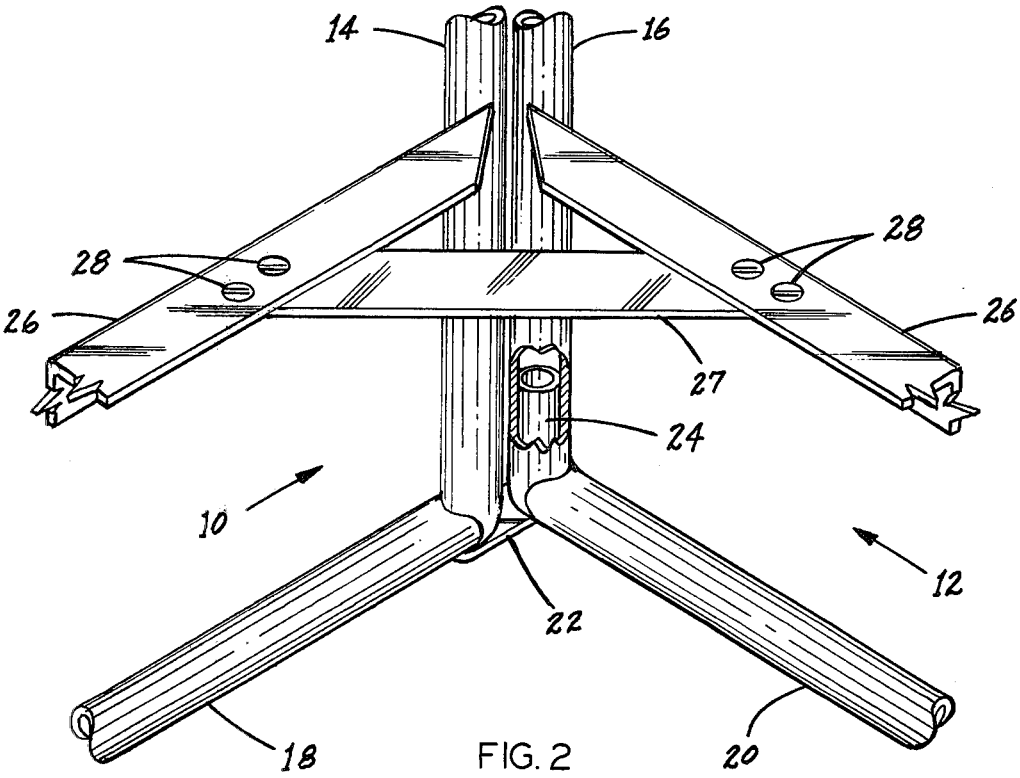

The article of furniture shown in FIGS. 1 and 2 is, for example, a chair. It includes a number of component parts, two of which 10 and 12 are shown in the drawings. As best shown in FIG. 2 these component parts 10 and 12 are to be assembled together with their upright sides 14 and 16 adjacent to one another.

Each component part includes a frame made of tubular steel including an upright portion constituting the side 14 or 16 and a lower horizontal portion 18 or 20. Joined by welding to the underneath of the portion 18 adjacent to the upright portion constituting the side 14 is a small steel plate 22. An upright length of tube 24 constitutes the spigot. This length of tube 24 is generally parallel to the side 14. The lower end of the upright portion constituting the side 16 is open and the hollow interior constitutes a socket into which the length 24, constituting a spigot, is inserted. This is best shown in FIG. 2 and fixes the two component parts 10 and 12 together at their lower ends.

At an intermediate position along the sides 14 and 16, lengths of angle iron 26 are joined to the upright portions of the frame constituting the side 14 or 16. The horizontally extending portions of these lengths of angle iron 26 provide a base on which a seat board and cushion can rest when the article is constituted by a chair.

A brace 27 is joined to the lengths of angle iron 26 by means of nuts and bolts 28. The brace forms a further connection between the two parts 10 and 12 so preventing the length 24 forming the spigot from leaving its socket. The brace has the additional function of holding the two parts 10 and 12 at right angles to one another.

It is very simple and quick to join the two parts 10 and 12 since the length 24 is merely inserted within the lower end of the side 16 and the brace 27 joined to the two lengths of angle iron 26 by the nuts and bolts 28. These are operations which a purchaser can complete in his own house once the component parts have been sent to him packed flat.

The table 40, part of which is shown at FIGS. 3A and 3B, includes adjacent parts 42 and 44 having portions **42*a* and 44*a*, respectively, constituting the top rail of the table and portions 42*b* and 44*b*** constituting a leg.

Each component part 42 or 44 includes a tubular metal frame 46 and, at their lower ends, these frames are joined by means of a spigot and socket arrangement including components 22 and 24 identical with those shown in FIGS. 1 and 2. They are not therefore shown in FIGS. 3A and 3B.

The table shown in FIGS. 3A and 3B is intended to have a glass top and so attached to the parts 42*a* and 44*a* forming the top rails are wooden ledges 48. These ledges are joined to the frames of the parts 42 and 44 by means of lengths of an angle iron 50. In order to hold the two adjacent portions 42 and 44 together, a short brace 52 is bolted to each of the lengths of the angle iron 50. As can be seen from the drawings, this brace 52 is positioned on the underside of the lengths of angle iron 50 and ledges 48 so as to be almost invisible when looking down on the table from above.

The table 60 shown in FIG. 4 includes a top 62 and side portions 64 and 66. The two side portions 64 and 66 have component parts 64*b* and 66*b* which together constitute a leg in a fashion similar to the parts 42*b* and 44*b* of the table 40. Again, at the lower ends of these parts 64*b* and 66*b* is provided a spigot and socket arrangement identical with that shown in FIGS. 1 and 2. For simplicity, it is not therefore shown in FIG. 4.

The portions 64 and 66 again have a tubular steel frame and at the upper portions 64*b* and 66*b*, the frame projects by short lengths 68. These lengths constitute spigots which are received into a pair of sockets 70 joined to a plate 72 fixed to the underside of the table top 62.

The portions 64 and 66 have horizontally extending lengths 64*a* and 66*b* respectively and joined to these lengths are small angle brackets 74. When the table has been assembled by first joining the portions 64 and 66 at their lower ends by the spigot and socket arrangement shown in FIGS. 1 and 2, the short lengths 68 are inserted into the socket 70 and the brackets 74 are joined to the table top by, for example, screws 76 so as to hold the whole table together.

What we claim is:

1. An article of furniture constituted by a plurality of separate interrelated frame component members configured for being interconnected in adjacent relationship to achieve an assembled condition of said article of furniture, characterized by each of said frame component members comprising a tubular component, means associated with at least one of said frame component members for defining a spigot, and means associated with at least one other of said frame component members for defining a corresponding spigot-receiving aperture for slidably receiving said spigot in fitted, telescoping relationship, said spigot and spigot-receiving aperture being oriented and presented for mutual telescoping interrelationship to position said interrelated component members in joined adjacent condition, and securement means associated with each of said frame component members, separate from said spigot and spigot-receiving aperture, for interengaging said frame component members to secure and maintain said mutual telescoping interrelationship and for maintaining said frame component members in assembled relationship in correct relative orientation, a first one of said frame members having a lower extremity including means presenting said spigot, the other of said frame members defining a spigot-receiving aperture for being seated upon said spigot, said first frame member being defined by an elbow-shaped tubular structure defining a corner, a plate extending from said corner and having said spigot extending upward from the corner remote end of said plate.

2. An article of furniture as claimed in claim 1 and further characterized by the other one of said frame members being also defined by an elbow-shaped tubular structure defining an elbow, said elbow constituting said corner unit including said aperture and including a tubular hollow interior for receiving said spigot.

3. An article of furniture as claimed in claim 2 and further characterized by said other one of said frame members being defined by a first length of circular section joined to a further length of circular section tubing, said aperture opening into the interior diameter of one of said lengths of tubing, said article of furniture comprising that of the wicker or rattan type, said frame component members being of steel tubing.

* * * * *